US005470304A

United States Patent [19]

Decanto

[11] Patent Number: 5,470,304

[45] Date of Patent: Nov. 28, 1995

[54] APPARATUS AND METHOD FOR PROVIDING PRESSURE POINT THERAPY

[76] Inventor: Anthony Decanto, 57 Ariel Ct., Neshanic, N.J. 08853

[21] Appl. No.: 320,563

[22] Filed: Oct. 11, 1994

Related U.S. Application Data

[63] Continuation of Ser. No. 59,002, May 6, 1993, abandoned, which is a continuation of Ser. No. 870,890, Apr. 20, 1992, abandoned.

[51] Int. Cl.[6] ..... A61H 7/00

[52] U.S. Cl. ..... 601/134; 606/204

[58] Field of Search ..... 601/134, 135; 602/19; 604/201, 204, 204.15, 204.25

[56] References Cited

U.S. PATENT DOCUMENTS

| | | | |
|---|---|---|---|
| 849,844 | 4/1907 | Laurence | 601/136 |
| 2,015,255 | 9/1935 | Charpier et al. | 128/63 |
| 2,320,183 | 5/1943 | Jungmann | 606/201 X |
| 2,835,247 | 5/1958 | Stabholc | 602/19 |
| 2,878,482 | 3/1959 | Rebajes | 2/311 X |
| 3,926,182 | 12/1975 | Stabholz | 602/19 X |
| 4,308,861 | 1/1982 | Kelly | 606/204 |
| 4,479,495 | 10/1984 | Isaacson | 606/204 |
| 4,557,262 | 12/1985 | Snow | 606/201 |
| 4,689,833 | 9/1987 | Daniels | 2/322 |
| 4,997,438 | 3/1991 | Nipper | 606/204 X |
| 5,094,227 | 3/1992 | Eglauf et al. | 606/204 X |
| 5,127,897 | 7/1992 | Roller | 602/19 |
| 5,290,307 | 3/1994 | Choy | 606/204 |

*Primary Examiner*—Robert A. Hafer
*Assistant Examiner*—Brian E. Hanlon
*Attorney, Agent, or Firm*—Arthur L. Plevy

[57] ABSTRACT

A belt for providing individual pressure points in a user's lower back region in order to alleviate back pain. The belt is secured about the waist and includes a main panel positioned against the lower back region. The main panel includes several apertures corresponding to possible points of therapy. Threaded pins are inserted into the apertures corresponding to a point in the lower back where pain is being experienced. The pins are rotated through the main panel into the lower back thus providing pressure to the point of interest in the lower back. The pressure can be adjusted by rotation of the pin as desired.

12 Claims, 1 Drawing Sheet

APPARATUS AND METHOD FOR PROVIDING PRESSURE POINT THERAPY

This is a continuation of application Ser. No. 08/059,002, filed on May 6, 1993, now abandoned, entitled Apparatus and Method for Providing Pressure Point Therapy, which is a Continuation of prior application Ser. No. 07/870,890, filed on Apr. 20, 1992, now abandoned.

FIELD OF THE INVENTION

This invention relates to lower back treatment devices and more particularly, to a belt for providing pressure to specific points in a user's lower back region.

BACKGROUND OF THE INVENTION

Lower back pain is a common ailment that affects many people. There are many reasons for lower back pain, including over exertion of the back muscles, incorrectly lifting heavy objects, disc herniation or degenerative disc disease. In addition, lower back pain may be the result of dislocated vertebrae or dorso-lumbar scoliosis. Treatment of lower back pain has been accomplished in several ways in the past.

One method applies traction to the lower back region of the spine in order to treat lower back pain. The lower back region typically includes the lumbar vertebrae of the spinal column and the area in the lower back that surrounds it. In this regard, reference is made to U.S. Pat. Nos. 2,835,247, 3,926,182 and 4,987,885 to Stabholz, and 3,889,664 to Heuser et al. Generally, these patents disclose lumbar traction devices having an upper belt, a lower belt and a tensioning mechanism disposed between the belts for forcing the belts apart. Such devices further include a lordosis pad positioned between the upper and lower belts. The lordosis pad is used to apply forward pressure against the lower back region and the spine while the spine is in tension.

In operation, the upper belt is tightened about a user's torso while the lower belt is tightened about the waist. The tensioning mechanism forces the belts apart, which tensions the spine and causes the vertebrae in the spine separate. Forward pressure is then exerted on the lower back region and the spine by the lordosis pad. This forward pressure controls the forward convexity of the spine, and can be used to reposition a dislocated vertebrae.

Other back treatment methods provide support and bracing for the lumbar vertebrae of the spinal column. In this regard, reference is made to U.S. Pat. No. 4,552,135 to Racz et al. This patent discloses a belt having a centrally located pad of a size to be received against and provide support for the lower back region. The pad includes an inflatable chamber. A valve is provided by which the volume of the chamber can be varied. When a user compresses the belt between their body and a seat back, air is expelled from the chamber. When the compression force is removed, air flows back into the chamber.

Frequently, however, back pain occurs in specific muscles or points of the lower back region. Such lower back pain may be the result of a sore muscle, muscle spasm or a pressure point in a muscle. When this occurs, it is desirable to apply a concentrated pressure to the specific painful point or muscle of the lower back region. Such treatment is known in the medical field as pressure point therapy. Moreover, the pain may be located in several distinct locations in the lower back, requiring the simultaneous application of concentrated pressure to each location in the lower back region.

Generally, finger pressure is a method utilized to alleviate such back pain. However, the application of pressure in this manner is limited by the amount of time a person is able to apply the finger pressure before becoming fatigued. In addition, it may be difficult to provide a constant pressure to the painful area.

Prior art back treatment devices generally provide for the application of pressure over an area of the lower back that includes the lumbar vertebrae of the spinal column and the area surrounding it. The application of pressure in this manner is utilized to control the forward convexity of the spine or to brace the spinal column. As such, the pressure is distributed over the lower back. Consequently, such prior art devices may not alleviate lower back pain when a concentrated pressure point is required. In addition, such prior art devices generally do not provide for the application of several concentrated pressure to points of the lower back region simultaneously. In addition, prior art lumbar traction devices are cumbersome, complicated and relatively expensive to produce.

The present invention circumvents the disadvantages in the prior art by providing a belt that enables the simultaneous application of concentrated pressure to points of the lower back region in order to alleviate lower back pain which is inexpensive to manufacture and easy to use.

SUMMARY OF THE INVENTION

Apparatus for providing pressure on a plurality of points in a user's lower back region comprising a belt for encircling said user and a plurality of pressure means extending through said belt in selected positions corresponding to each of said points for providing independently adjustable pressure on each of said points.

BRIEF DESCRIPTION OF THE FIGURES

The invention will be more clearly understood by reference to the following detailed description in conjunction with the accompanying drawings in which.

DETAILED DESCRIPTION OF THE INVENTION

Figure 1:
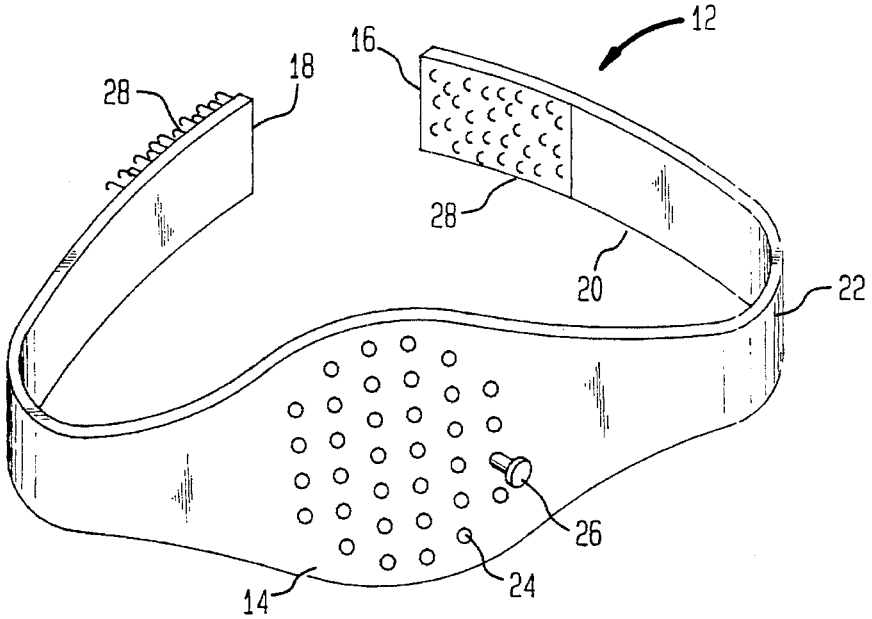
FIG. 1 depicts a belt for providing pressure point therapy in accordance with the present invention.

Referring to FIG. 1, an embodiment of the present invention is shown. A belt 12 includes a rigid main panel 14 that is disposed between elongated, flexible first 16 and second 18 end panels. In addition, the belt 12 has an inner surface 20 and an outer surface 22. The belt 12 may be unistructurally fabricated from molded plastic wherein the main panel 14 has a thicker cross section than either the first 16 or second 18 end panels in order to provide the necessary rigidity. Alternately, the belt 12 may be unistructurally fabricated from leather.

The main panel 14 is contoured to accomodate a user's lower back region and may be wider than either of the first 16 or second 18 end panels. A plurality of apertures 24 are formed in the main panel 14. The apertures 24 are positioned in predetermined locations in the main panel 14 to accomodate possible areas for pressure point therapy for the lower back region. By way of example, the apertures 24 may be arranged in a grid like configuration as shown in FIG. 1. Alternately, the apertures 24 may be arranged in a circular or any other geometric pattern desired.

A pin member 26 is positioned in one of the plurality of apertures 24 and is oriented substantially perpendicular to the outer surface 22. The pin member 26 may be advanced past the inner surface 20 to a desired depth into a point in the lower back region as will be explained hereinafter. This results in concentrated pressure being applied to a point in the lower back region, thus providing relief from back pain resulting from any of a variety of reasons including muscle spasms, pressure points, and the like. It is understood that the user may utilize a plurality of pin members simultaneously as desired to provide relief from pain in several different points in the back.

VELCRO fasteners 28 are affixed to the inner surface 20 of the first end panel 16 and to the outer surface 22 of the second end panel 18. The belt 12 is releasably secured about the waist of a user by overlapping the first 16 and second 18 end panels as will be explained in the description of FIG. 3.

Figure 2A:
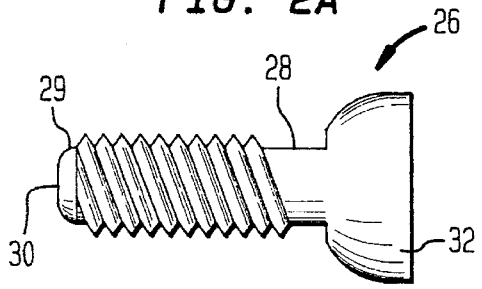
FIGS. 2A shows an embodiment of a pin member used in conjunction with a belt of the present invention.

Referring to FIG. 2A, a side view of a first embodiment of the pin member 26 is shown. The pin member 26 includes a shaft 28 having a threaded circumference and a first end 29. The pin member 26 further includes a cap 30 having a smooth, rounded outer surface which is rotatably mounted to the first end 29. The cap 30 has a outer diameter of approximately 0.25 inch to provide point contact and thus concentrated pressure when it is advanced into the lower back region. In addition, a handle 32 is unistructurally formed with the shaft which is contoured to accomodate the user's fingers. In this configuration, each of the apertures 24 (FIG. 1) in the main panel 14 include threads that complement the threads of the pin member 26.

Figure 2B:
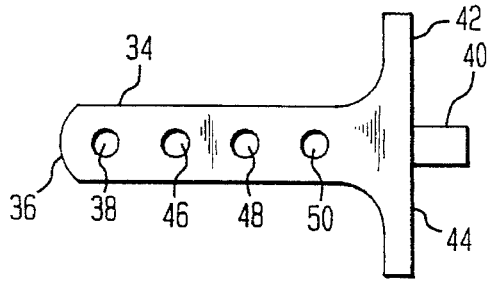
FIG. 2B shows an alternate embodiment of the pin member.

Referring to FIG. 2B, a side view of an alternate embodiment of the pin member 26 is shown. The p in member 26 includes a hollow shaft 34 having a closed, rounded end 36. The hollow shaft 34 has an outer diameter of approximately 0.25 inch to provide point contact and thus concentrated pressure when it is advanced into the lower back region. First 38, second 46, third 48 and fourth 50 ball bearings are disposed along the hollow shaft 34 and positioned within openings in the hollow shaft 34. As can be readily ascertained, a plurality of ball bearings may be used. A plunger 40 is positioned on a first end 42 of the hollow shaft 34. The hollow member 34 includes a mechanism (not shown) that is connected between the plunger 40 and the ball bearings 38,46,48,50 that retracts the ball bearings 38,46,48,50 into the hollow shaft 34 when the plunger 40 is depressed. Release of the plunger 40 returns the ball bearings to their respective openings in a fixed position. Such mechanisms are well known in the art and need not be described herein. A flange 44 is unistructurally formed with the hollow shaft 34. The flange 34 is contoured to the user's fingers and enables manipulation of the plunger 40. In this configuration, the apertures 24 of the main panel 14 include a notch (not shown) that is formed to receive one of the ball bearings 38,46,48,50. When this occurs, the hollow shaft 34 and thus the pin member 26 become rigidly connected to the main panel 14.

Figure 3:
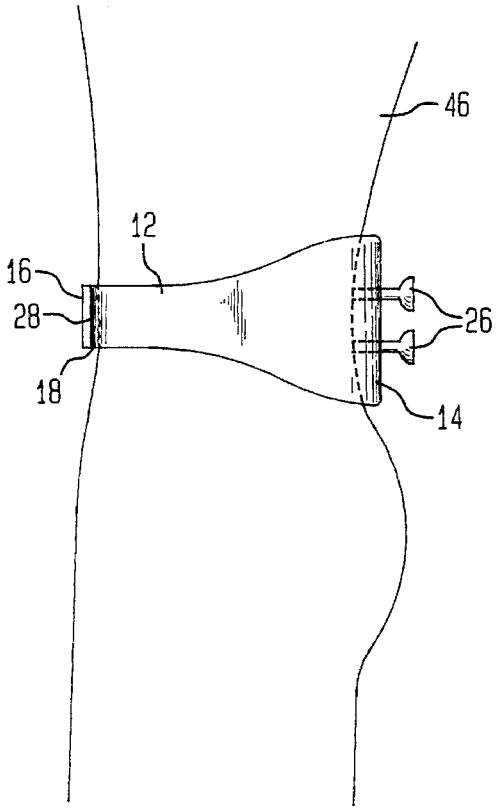
FIG. 3 illustrates present invention secured about the waist of a user.

Referring to FIG. 3, the present invention is shown secured about the waist of a user 56 and with pin members 26 positioned to provide pressure to points in the lower back region. By way of example, the operation of the first embodiment of the pin member 26 and belt 12 will be described in conjunction with FIGS. 1 and 2A. In operation, the user 56 selects an aperture 24 which corresponds to the back pain being experienced in the lower back region.

The pin member 26 is then threadably engaged in the aperture 24 and advanced towards the lower back by manipulating the handle 32 and rotating the shaft 28. Since the cap 30 is free turning with respect to the shaft 28, the cap 30 does not rotate when it contacts the lower back as the shaft 28 is being rotated. The cap 30 thus protects the user from a cut, abrasion or other injury that may occur as the pin member 26 is advanced into the user's back. The pin member 26 may then be retracted from the lower back region by manipulating the handle 32 and rotating the pin member 26 in an opposite direction. It is understood that the pin member 26 may be advanced into the lower back region and retracted from it as desired by the user 56 to adjust pressure on the point of interest in the lower back.

In addition, the operation of the alternate embodiment of the pin member 26 and belt 12 will be described in conjunction with FIGS. 1 and 2B. The user 56 selects an aperture 24 which corresponds to the back pain being experienced in the lower back region. The plunger 40 is depressed and the pin member 26 is inserted into the desired aperture 24. The depth that the pin member 26 may be advanced into the user's 56 back corresponds to the position of each ball bearing 38,46,48,50 with respect to the main panel 14. In the present embodiment, four separate depths into a user's 46 back may be obtained. It is understood that the smallest advance into a user's 56 back is obtained when the first ball bearing 38 is received by the notch and that the deepest advance is obtained when the fourth ball bearing 50 is received by the notch. The pin member 26 is then advanced to desired depth into a user's 56 back. When this is achieved, the user 56 releases the plunger 40 so that the ball bearing nearest the notch is received by the notch, thus rigidly attaching the pin member 26 to the main panel 14. It is understood that pressure may be adjusted by depressing the plunger 40 and adjusting to the next ball bearing until a desired pressure is reached.

The belt 12 is secured by overlapping the first panel 16 over the second panel 18 and engaging the VELCRO fasteners 28 previously described. The overlap of the first 16 and second 18 panels can be varied by the user, thus enabling the belt 12 to provide variable adjustment and accomodate users having various waist sizes. It is understood that the belt 12 may be releasably secured by any method known in the art.

Those skilled in the art recognize that further embodiments of the present invention may be made without departing from its teachings and that the present invention is not limited to the specific embodiments described above.

What is claimed is:

1. Apparatus for providing pressure on a plurality of localized points in a user's lower back region corresponding to predetermined locations for pressure point therapy in said lower back region, comprising:

a belt for encircling the lower torso of the user, said belt having a rearward section thereon that faces the user's lower back region when worn by the user;

a two dimensional array of apertures arranged generally in a plurality of columns and rows on said rearward section, wherein the number of said apertures in certain of said columns is not the same as the number of said apertures in certain other columns and the number of said apertures in certain of said rows is not the same as the number of said apertures in certain other rows in order to conform to the muscles in the lower back region of a user, said array of apertures providing the user with a choice of predetermined locations on said rearward section corresponding in location to the localized points on the user's back; and a plurality of rigid compression elements for providing independently adjustable point compression to a selected plurality of said localized points, each of said rigid point compression elements being a shaft of substantially constant diameter which is no greater than the diameter of said apertures, each of said shafts extends a predetermined distance through one of said apertures in said array, wherein each said rigid point compression element has an adjustable engagement means thereon for engaging said rearward section defining said array, whereby said adjustable engagement means enables said predetermined distance to be selectively altered to thereby independently adjust the pressure applied at each location.

2. The apparatus according to claim 1, wherein said adjustable engagement means includes an external thread for threadably engaging said rearward section defining said apertures and each of said rigid point compression elements further including a first end having a cap rotatably mounted thereon for contacting one of the localized points, thereby enabling said shaft to rotate independently of said cap when said cap contacts the localized point.

3. The apparatus according to claim 1, wherein said adjustable engagement means includes means for providing step advancements and retractions of each of said rigid point compression elements onto one of the localized points thereby providing adjustable point pressure on the localized point.

4. The apparatus according to claim 1, wherein said belt is fabricated from molded plastic.

5. The apparatus according to claim 1, wherein said belt is fabricated from leather.

6. Apparatus for providing pressure on a plurality of localized points in a user's lower back region corresponding to predetermined locations for pressure point therapy in said lower back region, comprising:

a belt for encircling the user's lower back region, said belt having a panel and a first and second end, said panel including a two dimensional array of apertures disposed therein generally in a plurality of rows and columns, wherein the number of said apertures in certain of said rows is not the same as the number of said apertures in certain other rows and the number of said apertures in certain of said columns is not the same as the number of said apertures in certain other columns, wherein said array of apertures provides the user with a choice of predetermined locations for accommodating each of the localized points in the user's back;

a plurality of rigid point compression means for providing independently adjustable point compression of each of said localized points, each of said rigid point compression means extending through one of said apertures in said array of apertures, each of said rigid point compression means including a rigid pin member being a shaft of substantially constant diameter with said diameter being no greater than the diameter of each of said apertures, said shaft engaging one of said apertures and advancing said pin member onto one of the localized points and retracting said pin member therefrom, thereby providing adjustable point pressure on the localized point; and fastening means for releasably fastening said first end to said second end.

7. The apparatus according to claim 6, wherein said shaft includes means for threadably engaging said one of said apertures and a first end having a cap rotatably mounted thereon for contacting one of the localized points, thereby enabling said shaft to rotate independently of said cap when said cap contacts the localized point.

8. The apparatus according to claim 6, wherein said pin member and said apertures include means for providing step advancements and retractions of said rigid pin member onto one of the localized points thereby providing adjustable point pressure on the localized point.

9. The apparatus according to claim 6, wherein said panel is curvably contoured on the upper and lower edges of said panel to accommodate said lower back region.

10. The apparatus according to claim 6, wherein said belt is fabricated from molded plastic.

11. The apparatus according to claim 6, wherein said fastening means include microhoop and microhook fasteners.

12. The apparatus according to claim 6, wherein said belt is fabricated from leather.

* * * * *